United States Patent [19]

Kumeth

[11] Patent Number: 4,644,777

[45] Date of Patent: Feb. 24, 1987

[54] DEVICE FOR GROOVING CYLINDRICAL WORKPIECES

[76] Inventor: Siegmund Kumeth, Bayreuther Strasse, 8450 Amberg, Fed. Rep. of Germany

[21] Appl. No.: 773,874

[22] Filed: Sep. 9, 1985

[30] Foreign Application Priority Data

Sep. 7, 1984 [DE] Fed. Rep. of Germany ..... 3432939
Dec. 15, 1984 [DE] Fed. Rep. of Germany ..... 3445806

[51] Int. Cl.[4] ..... B21D 17/02
[52] U.S. Cl. ..... 72/402; 72/450
[58] Field of Search ..... 72/402, 399, 393, 76, 72/450; 29/237, 283.5

[56] References Cited

U.S. PATENT DOCUMENTS

| | | | |
|---|---|---|---|
| 279,124 | 6/1883 | Brainard | 72/76 |
| 330,114 | 11/1885 | Higgins | 72/76 |
| 540,906 | 6/1895 | Dayton | 72/76 |
| 1,306,232 | 6/1919 | Ruth | 72/402 |
| 1,480,077 | 1/1924 | Johnson | 72/402 |
| 3,203,078 | 8/1965 | Ustin | 72/402 |
| 3,685,341 | 8/1972 | Karsnak | 72/450 |
| 4,434,645 | 3/1984 | Svercl et al. | 72/402 |

*Primary Examiner*—Daniel C. Crane
*Attorney, Agent, or Firm*—Charles W. Fallow; Martin P. Hoffman; Mitchell B. Wasson

[57] ABSTRACT

A device is disclosed for forming axial grooves in cylindrical workpieces. The device includes a first tool part having a receiver for the workpiece, and at least one lever pivotably mounted within the first tool part. The lever supports a grooving tool provided with a cutting edge facing the receiver. The lever also has a first bearing or supporting surface on the side opposite the cutting edge, against which one end of a clamping bolt abuts. The clamping bolt is driven by a second tool part rotatably supported on the first tool part so that it can pivot around the receiver axis.

7 Claims, 3 Drawing Figures

DEVICE FOR GROOVING CYLINDRICAL WORKPIECES

BACKGROUND OF THE INVENTION

The invention relates to devices for forming grooves in workpieces, especially cylindrical work-pieces.

In construction engineering, as in many other areas of technology, cylindrical workpieces—bolts, for example—are needed that are provided with at least one groove on their peripheries—that is, with a depression imprinted in the workpiece by permanent distortion of the material of the workpiece and preferably extending longitudinally along the workpiece. A typical example of such workpieces in a so-called "slotted pin", which is used as a connecting element.

Devices for forming grooves in workpieces and especially in cylindrical workpieces, are already known. However, constructing the known devices takes a relatively large amount of time and money. Another disadvantage of the known devices is that the tools or tool assemblies that are used have groove cutting edges that wear out relatively quickly and consequently have to be replaced very frequently, thus, the known devices have a relatively short edge life.

The basic task of the invention is to produce a device for making grooves in workpieces which, because of its relatively simple and therefore inexpensive construction, provides the best possible application of power on the workpiece to be grooved, the best possible distribution of forces in the grooving device, and a long edge life.

To accomplish this task, a device constructed in accordance with the invention includes a first tool part having a receiver for the workpiece, at least on lever pivotably mounted on the first tool part, said lever supporting a tool provided with a cutting edge on its side facing the receiver, the lever further having a first bearing or supporting surface on its side opposite the cutting edge against which one end of a clamping edge butts; and a second tool part that is attached to the first tool part so that it can pivot around an axis of the receiver, the second tool part having a second bearing and supporting surface for the clamping bolt on its side that faces the receiver.

The device of the invention is unique in that is has the best possible construction, wherein the forces that arise and must be controlled during the grooving process are concerned; that means, above all, that powerful forces can be controlled and can be generated for the grooving process even though the tools and the device being used are small. It is also possible, with the tools and the device of the size provided, to groove large diameter cylindrical workpieces or workpieces of other shapes. It is also possible to form grooves of considerably greater length, width and/or depth in a workpiece, than is possible with other known tools and devices of the same size.

In the device of the invention, the transmission of power to the grooving lever is accomplished through a clamping bolt, one end of which abuts against the lever or a first bearing and supporting surface thereon, while its other end abuts against a second bearing and supporting surface that is provided on the second tool part. Since the second tool part, in relation to the first tool part, can be pivoted around an axis coinciding with the axis of the workpiece receiver, the clamping bolt acts as a toggle lever. That is, in the initial or normal position of the second tool part, the axis of the clamping bolt is at a slightly oblique angle to a line running radially to the workpiece receiver and through the first bearing and supporting surface. When the second tool part pivots or rotates into its operating position, the longitudinal extension of the clamping bolt coincides or nearly coincides with the axis of that radial line. Thus, in the operating position, in which the cutting edges of the tool assemblies are pressed into the material of the workpiece, the longitudinal extension of the clamping bolt makes a considerably smaller angle with the radial line than in its normal position. As a result, when the second tool part rotates or pivots into the operating position, powerful forces are applied to the lever.

In a preferred embodiment of the device of the invention, the second tool part is annular and is attached to a ring surface of the first tool part that is attached concentrically to the workpiece receiver. As a result, a support for the second tool part emerges that has a large surface and hence is the best possible support. Furthermore, as a result of making the second tool part an annular element, the best possible distribution of power is obtained in that tool part—that is, the second tool part can carry a heavy load because of its annular construction.

In the preferred embodiment of the invention, several levers are distributed around the workpiece receiver and each having at least one tool or tool assembly, with each lever then being operatively connected to the second tool part by a clamping bolt. Several grooves can thus be formed in a workpiece in one working operation. At the same time, the optimum construction, from the point of view of strength, is provided by a device of this type since forces exerted upon the workpiece by the individual tool assemblies in grooving cancel each other out.

It is evident that not only grooves in the literal sense, but also other indentations, can be put into workpieces with the device of the invention, so that the word "groove," when used in connection with the invention, should be understood to mean any kind of indentation.

The phrase "cutting edges", as used herein should be understood to meat not only elongated cutting edges, in the literal sense, but also working surfaces of tools or tool assemblies that come to a point, including cone-shaped working surfaces for impressing conical indentations in to workpieces, for example. The tool having a cutting edge can also be a wheel (a groove wheel) provided with a cutting edge.

To obtain especially favorable conditions for driving the second tool part from its normal position to its operating position and back again to its normal position and also to obtain a steady movement or pivoting of the second tool part that is as noiseless as possible, one end of an operating lever is fastened to the second tool part. The length of the operating lever is at right angles to the axis enclosing the receiver; its other end is hinged to one end of an intermediate lever. The other end of the intermediate lever is provided with a bearing with which a circular-cylindrical eccentric of an eccentric drive meshes. This results in not only the best possible transmission of power to the second tool part, but also in a very steady movement that avoids abrupt acceleration, and thus the device is made to run quietly.

The workpieces that are to receive at least one groove are preferably delivered to the device of the invention in a synchronization, with the movement of the second tool part being synchronized with the delivery of the workpieces in such a way that every time the second tool part is in its normal, or initial, position a new workpiece is moved into the workpiece receiver. The removal of the workpiece that has received at least one groove from the workpiece receiver takes place when the second tool part has returned to its normal, or initial, position. But the removal of the workpiece can also take place or begin when the second tool part has reached its final operating position.

Especially when a wheel (a groove wheel) provided with a cutting edge on its peripheral area is being used as a tool, it is also possible to move the workpiece that is being processed at any one time into the workpiece receiver even before the second tool part has reached its final operating position, in order to produce grooves whose depth increases from one end to the other.

With the device of the invention, individual pinlike or boltlike workpieces can be processed, or a continuous piece of steel wire can be provided with individual grooves and then be divided up into individual workpieces.

The invention is described in greater detail in the following description of a preferred embodiment, with reference to the drawings.

DESCRIPTION OF A PREFERRED EMBODIMENT

Figure 1:
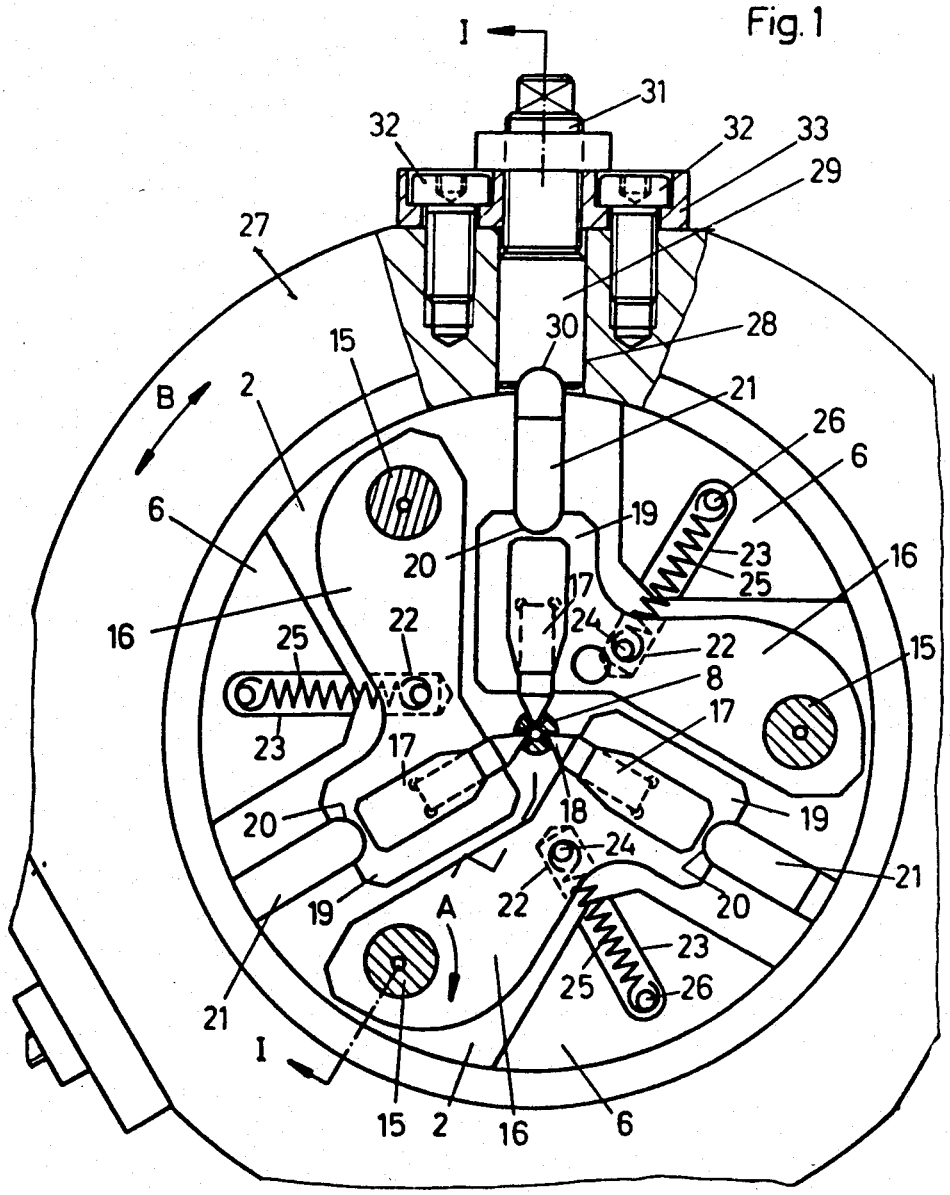
FIG. 1 is a simplified representation, partially in longitudinal section, of an embodiment of the device of the invention.
Figure 2:
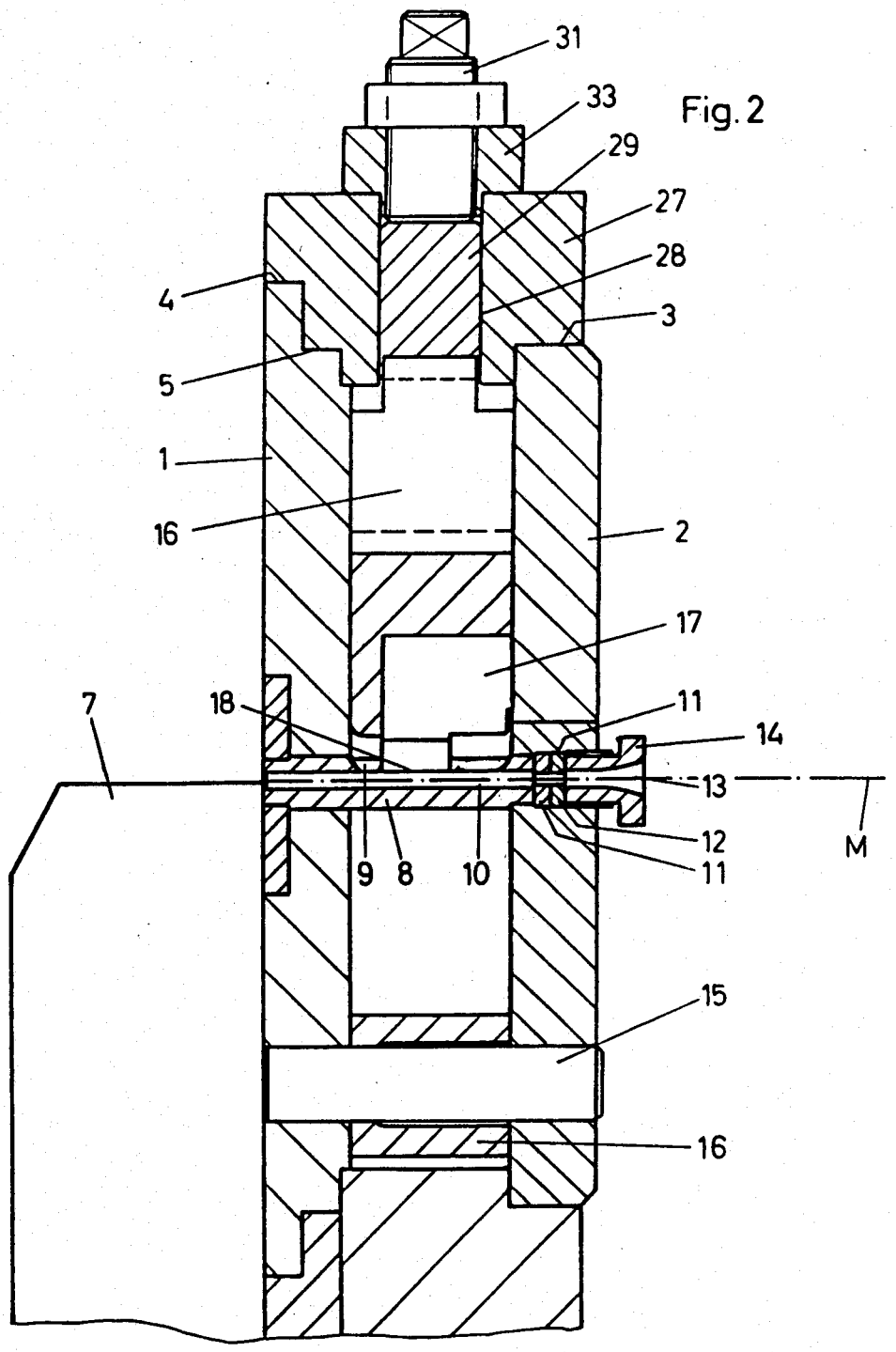
FIG. 2 shows a section along the line I—I in FIG. 1.
Figure 3:
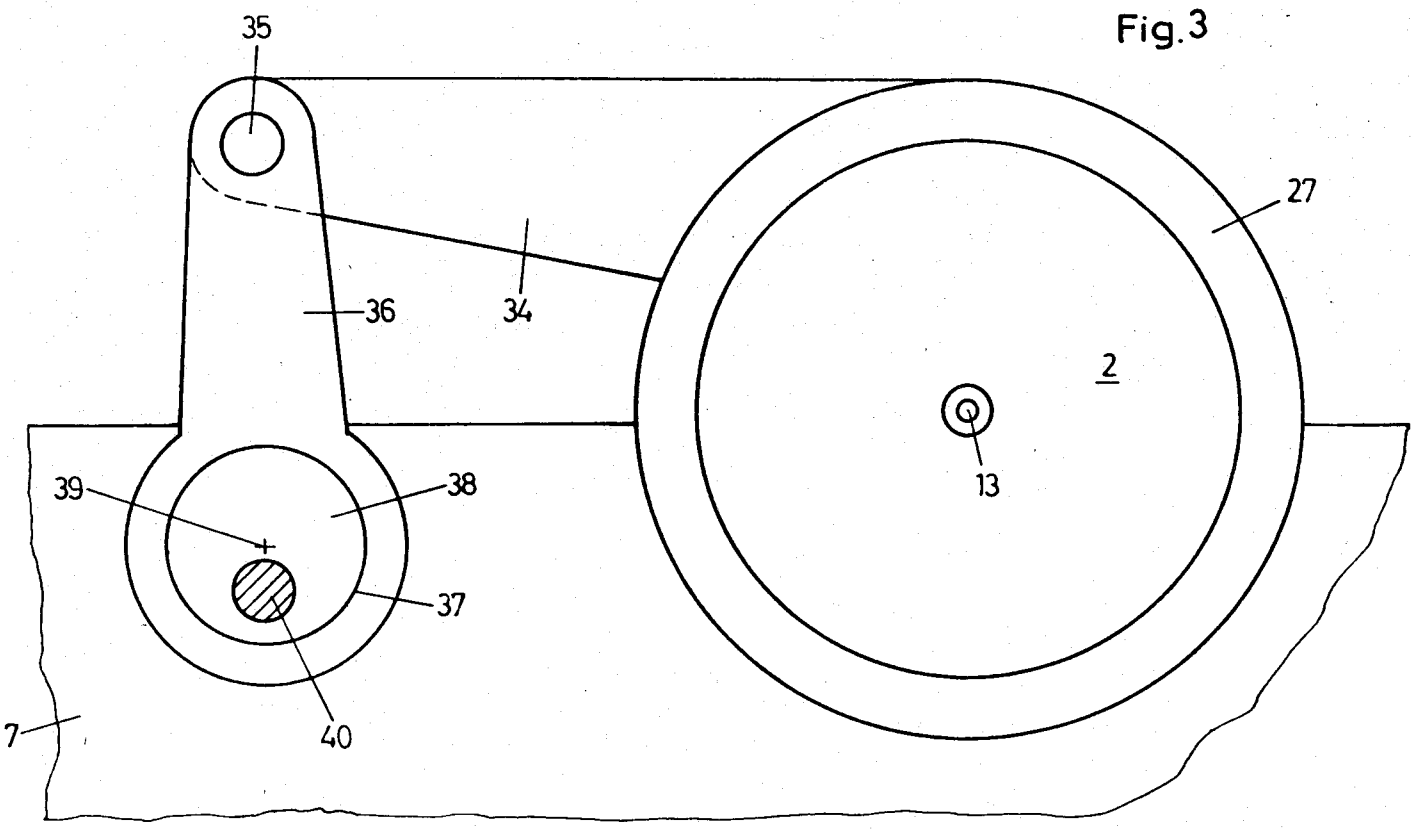
FIG. 3 is a side view of the device.

The device depicted in the drawings has two plates or plate bars 1 and 2 that are at a distance from and parallel to each other, with plate 2 being disk-shaped and being provided with a ring-shaped peripheral area 3, and plate 1 having a step-shaped or recessed peripheral area formed by two flat areas 4 and 5 that also are ring shaped. The peripheral area 3 and the two flat areas 4 and 5 are concentric, in each case, with a central axis M of the first tool part formed by the two plates 1 and 2 that runs at right angles to the side surfaces of the plates 1 and 2. The surface area 4 is further from the central axis M than is the surface area 5, whose distance from the central axis M is approximately the same as the distance from the surface area 3 to the central axis.

The side surfaces of the two plates 1 and 2 that face each other are interconnected by three blocks 6 having the approximate shape of segments of circles that are arranged at equal distances from each other around the central axis M and in a plane of cross section at right angles to the central axis M, as shown in FIG. 1. The surface of the plate 1 that is turned away from the plate 2 is fastened to a fixed stand 7 for the device. In the central area of the tool part formed by the two plates 1 and 2, a jacket 8 is located, both ends of which have holes drilled through them to hold the plates 1 and 2 and which also are located concentrically with the central axis M. In its central area, located between the plates 1 and 2, this jacket, which serves as a workpiece receiver, is provided with three slots 9 offset with respect to each other by 120°, in each case, along the periphery of the jacket and extending in the direction of the central axis M, that extend from the outer surface of the jacket 8 into the inner space and into the hole 10 drilled into that jacket. In a sectional plane running at right angles to the central axis M. each of the slots 9 has a V-shaped cross section that spreads from the drilled hole 10 to the outer surface of the jacket 8.

At the end of the jacket 8 that is seated in the drilled hole 11 in the plate 2, the drilled hole 10 in that jacket continues in the internal drilled hole 12 made of elastic material and then in the internal drilled hole 13 in a jacket element 14 that is screwed into a threaded section provided in the drilled hole 11 by means of outside screw threads. The drilled hole 13 expands like a funnel toward the free end of the jacket element 14, which projects over the side surface of the plate 2 that is turned away from the plate 1.

In the plates 1 and 2, both ends of three clamping bolts 15, each located at the same radial distance from the central axis M and each offset by 120° around that central axis M, are held in the plates 1 and 2. A lever 16 located between the plates 1 and 2 is supported pivotably, at one end, on a pivot pin that lies with its axis parallel to the central axis M, and that is done in the space formed between two neighboring blocks 6. At its other end, on a surface facing the central axis M and running approximately parallel to that central axis, each lever 16 carries a tool assembly 17 that forms a cutting tool 18 on a chisel-like step running approximately radially to the central axis M, with the cutting tool's longitudinal extension running parallel to the central axis M. Each tool assembly 17 extends into one of the perforations 9 with its chisel-like step.

On its side opposite the cutting edge 18, each lever 16 is shaped like a hammer head with a shoulder 19 and has a semicircular depression 20 (on that side of the shoulder facing away from the cutting edge 18) whose plane of symmetry, along with the cutting edge 18, is radial to the central axis M. The depression 20 in each lever 16 serves as a bearing or supporting surface for a hemispherically or semicylindrically rounded end of a plunger or a clamping bolt 21.

In the central area, the side of each lever 16 that is turned away from the central axis M is provided with a blind drilled hole 22 opposite the open end of a blind drilled hole 23 that is provided in a block 6 and whose axis coincides approximately with the axis of the blind drilled hole 23 or a corresponding milled-out recess. One end of a tension spring 25 is attached to a pin 26 in the blind drilled hole 23. Since the pin 26 is always located radially farther out than the pin 24 in relation to the central axis M, each tension spring 25 biases it respective lever 16 in a direction that tends to increase the distance between the cutting edge 19 and the central axis M—that is, in the direction shown by the arrow A in FIG. 1.

On the ring surfaces formed by the peripheral area 3 and the flat areas 4 and 5, an essentially annular tool part 27 is movably seated for movement through a certain angular range around the central axis M in relation to the first tool part formed by the plates 1 and 2, as indicated by the double arrow B in FIG. 1. At each of three areas, spaced 120° apart, around the central axis, the tool part 27 is provided with a through-recess 28 that extends radially with respect to the central axis M and preferably has a non-circular cross section—for example, a square cross section. In each recess 28, a block 29 fitted to the cross section of that recess is located so that it can be displaced radially in the direction of the central axis M, and in fact this is done in such a way that the side of each block 29 that faces the central axis M is opposite the shoulder 29 of a lever 16. A semicylindrical or hemispherical depression 30 is provided on that side of every block 29, which depression serves as a bearing and supporting surface for the other end of a pressure plate or clamping bolt that is located radially farther out and also is semicylindrical or hemispherical. Against the side of each block 29 that is turned away from the central axis M there abuts one end of a tension rod or adjustment bolt 31 having external screw threads. The bolt is located with its axis radial to the central axis M, and its threads engage the threads of a taphole in a plate which is fastened with bolts 32 to the peripheral area of the tool part 27. The adjustment of the device by means of the adjustment bolt 31 is accomplished in such a way that, in a position of the tool part 27 in which the central axis of a depression 30 in each block 29 coincides with the central axis of a depression 20 in a respective lever 16, the longitudinal extension of the clamping bolt 21 providing support between these two depressions is positioned radially to the central axis M. All the tool assemblies 17 extend with their cutting edges 18 through the slots 9 into the interior or into the drilled hole 10 of the jacket 8 an amount that corresponds to the depth of the grooving that is to be produced in the workpiece.

If the tool part 27 is moved out of the operating position shown in FIG. 1 to its initial position by pivoting the tool part 27 counterclockwise through a small angular amount, the effective distance between any two recesses 20 and 30 is increased. Consequently, the ends of the levers 16 supporting the tool assemblies 17 are always pivoted radially outward by the respective tension springs 25. Since the levers 16 are always blased against the clamping bolts 21 by the tension springs 25, they are held safely in any position of the tool part 27.

To pivot the tool part 27 in relation to the tool part formed by the plates 1 and 2, the tool part 27 is provided with an operating lever 34 whose longitudinal extension is positioned at right angles to the central axis M. The operating lever 34 is made in such a way that it and the tool part 27 constitute a single piece; its end that is remote from the tool part 27 is embedded in a suitable socket 35 in one end of an intermediate lever 36.

At the other end of the intermediate lever 36 is a bearing 37 with which eccentric cylindrical driver 38 meshes. The axis 39 of driver 38 is parallel to the tool axis M. Driver 38 is an eccentric drive element which rotates around an axis 40 offset with respect to the axis 29. When the driver 38 rotates around axis 40, the activating lever 34, and consequently the tool part 27, are oscillated back and forth around the axis M, as is indicated by the double arrow B, as the intermediate lever **3*b*** is put under tension.

In operation, the delivery of individual pin-shaped or bolt-shaped workpieces is synchronized with the oscillation of the tool part 27—that is, with the motive power supplied by the driver 38—in such a way that, whenever the tool part 27 is in its initial position, the workpiece may be introduced into the workpiece receiver. The workpiece is protected against slipping within the jacket 8 to some extent by the rings 12, which are made of elastic material. After the workpiece is introduced into the jacket, the tool part 27 is then pivoted into its operating position by the operating lever 34 and by the eccentric drive 38. As a result, the tool assemblies 17, with their cutting edges 28, press through the slots 9 into the periphery of the workpiece, thereby producing the desired grooves.

After the tool part 27 is returned to its initial position, the workpiece, which is within the jacket 8 and has been grooved, is ejected and a new workpiece is introduced into the jacket 8. In this connection, it is desirable to provide for delivery and removal of the workpieces on different ends of the jacket 8, so that the workpieces will be moved through the jacket 8 in a single direction when they are being processed. Instead of grooving pin-shaped or bolt-shaped workpieces, sections of steel wire may be moved through the jacket 8 and given the desired grooves by the device, and when this is done the steel wire may be divided or cut up into individual pin-shaped or bolt-shaped workpieces after the grooving has been performed.

Inasmuch as the invention is subject to may variations and changes in detail, it is intended the the foregoing description should be regarded as merely illustrative of the invention defined by the following claims.

What is claimed is:

1. A device for forming grooves in workpieces, and especially in cylindrical workpieces, comprising a first tool part defining a receiver for the workpiece, at least one lever pivotably mounted on said first tool part, said lever having a tool provided with a cutting edge on the side of the lever facing the receiver, said lever also having a bearing surface on the side opposite said cutting edge;

a clamping bolt having one end in abutment with said surface; and a second tool part pivotally attached to the first tool part so that said second tool part can pivot around the axis of said receiver, said second tool part having a second bearing and supporting surface for the clamping bolt on its side that faces the receiver, an operating lever whose longitudinal extension is at right angles to the axis of the receiver, said operating lever being attached at one end to the second tool part, an intermediate lever attached at one end to the other end of the operating lever, a bearing attached at the other end of the intermediate lever, and a circular-cylindrical eccentric engaged within said bearing, said eccentric having an axis of rotation parallel to the receiver axis.

2. A device as claimed in claim 1, wherein the driving of the second tool part takes place through the operating lever, through the intermediate lever and through the eccentric drive in such a way that the intermediate lever is subjected to tension when the second tool part is moved into its operating position.

3. A device as claimed in claim 1, wherein said second tool part is attached to a ring surface of the first tool part that is disposed concentrically to the receiver.

4. A device as claimed in claim 1, further comprising a plurality of levers distributed around the workpiece receiver at equal angular distances, said levers being pivotably mounted on the first tool part, and wherein the cutting edges provided on said levers are interspaced at equal angular distances around the workpiece receiver.

5. A device as claimed in claim 1, wherein said workpiece receiver comprises a slotted jacket whose axis coincides with the axis of the ring surface of the first tool part.

6. A device as claimed in claim 1, wherein said second bearing and supporting surface is adjustable in a direction radial to the workpiece receiver.

7. A device as claimed in claim 1, wherein said lever is biased by a spring element in a direction to move its cutting edge away from the workpiece receiver.

* * * * *